United States Patent [19]

Babuin

[11] Patent Number: 4,696,171

[45] Date of Patent: Sep. 29, 1987

[54] LAUNDRY WASHING MACHINE

[75] Inventor: Piero Babuin, Pordenone, Italy

[73] Assignee: Zanussi Elettrodomestici SPA, Pordenone, Italy

[21] Appl. No.: 799,986

[22] Filed: Nov. 20, 1985

[30] Foreign Application Priority Data

Nov. 20, 1984 [IT] Italy ..... 45725 A/84

[51] Int. Cl.[4] ..... D06F 37/00

[52] U.S. Cl. ..... 68/207; 68/208; 137/387

[58] Field of Search ..... 68/12 R, 207, 208; 137/387, 453; 134/56 R, 57 R, 58 R, 94, 201

[56] References Cited

U.S. PATENT DOCUMENTS

| | | | |
|---|---|---|---|
| 3,133,433 | 5/1964 | Gebel | 68/17 R X |
| 4,168,615 | 9/1979 | Condit | 137/387 X |
| 4,206,780 | 6/1980 | Manecke et al. | 137/387 |
| 4,580,421 | 4/1986 | Babuin et al. | 68/207 X |

*Primary Examiner*—Harvey C. Hornsby
*Assistant Examiner*—Frankie L. Stinson
*Attorney, Agent, or Firm*—Wenderoth, Lind & Ponack

[57] ABSTRACT

A washing machine comprising a tub (4), a wash basket (5) and a housing (12) for collecting the wash water. A heating element (14) and a thermostatic sensor (15), as well as a recirculation pump (17) are connected to the housing (12) and to the tub (4) through a recirculation conduit (16) in order to circulate the wash water repeatedly toward the tub (4) with the object of spraying the same onto the load to be washed. The machine is moreover equipped with pressure switches (36,23) for carrying out "vigorous" and "delicate" laundering procedures in the conventional way, and has a series of pressure switches (21, 22) for developing "vigorous" wash cycles with low water levels in the tub (4) carried out by recirculating the same water toward said tub. In this way, optimum consumption of water, detergents and electric energy is achieved dependent upon the kind and quantity of load placed in the wash basket (5).

21 Claims, 2 Drawing Figures

LAUNDRY WASHING MACHINE

BACKGROUND OF THE INVENTION

The invention relates to a washing machine capable of efficiently washing all kinds of laundry, having a wash basket with varying load capacities and operating with differing wash water levels in the tub.

U.S. application, Ser. No. 677,302, filed Dec. 3, 1984 describes a washing machine comprising a wash tub, a wash basket, and a housing for collecting the wash water placed in a position beneath and connected to the tub. The housing is profiled so as to contain at least one filter element, one electric heating element and one thermostatic sensor capable of, respectively, filtering, heating, and sensing the temperature of the wash water.

This housing is connected both to the discharge hose of the washing machine by means of a conventional draining pump and to the wash tub by means of another hose. An electric recirculation pump is spaced a distance from, or concentrically with, the draining pump. The electric recirculation pump has an intake hose connected to the housing and a delivery hose connected to the tub.

The washing machine disclosed in U.S. application, Ser. No. 677,302 is suitable for conventional "vigorous" and "delicate" type laundering operations for washing heavily soiled articles of clothing. The wash cycles are performed with normal filling levels of the wash water in the tub while keeping the electric recirculation pump turned off throughout the duration of the wash cycles. The "vigorous" laundering operations for washing lightly soiled items are carried out with low filling levels of the wash water in the tub and switching on the electric recirculation pump during predetermined periods of the wash cycles in order to circulate the wash water repeatedly from the housing to the tub.

In particular, these latter "vigorous" laundering operations with low filling levels of wash water result in a remarkable lowering of the consumption of water, detergents, and electrical energy when compared to wash cycles of conventional washing machines.

Moreover, the washing machine disclosed in U.S. application, Ser. No. 677,302 is equipped with a first and second series of pressure switches or similar water-level regulators associated with, respectively, the "vigorous" laundering operations for low filling levels, and the "vigorous" laundering operations for normal water levels in the tub. These pressure switches are switched on one-by-one by means of the corresponding manually-operated switches before the start of every wash cycle, depending on the particular load placed in the basket.

For example, the first series consists of three pressure switches for laundering, respectively, a full, a half, and a quarter, of a wash load, while the second series consists of two pressure switches for laundering, respectively, a full, and a half wash load. This washing machine also has another pressure switch calibrated for a filling level of the wash water in the tub which is different from the prior art pressure switches and enables the "delicate" laundering operations, such as for delicate synthetic fabrics and/or woolens.

However, a washing machine as described above, despite its satisfactory and reliable operation, has the disadvantage of requiring a considerable number of pressure switches or similar water-level regulators in order to determine preset filling levels of the wash water in the tub which correspond to the loads placed in the basket.

Furthermore, in order to carry out each laundering operation in the washing machine discussed above, it is necessary for an operator to manually selectively actuate the pressure switches. These pressure switches can also be used to carry out laundering operations of the type described earlier, but with loads in the wash basket differing from full, half and quarter wash loads. In these instances, it is possible to wash the load efficiently, but without optimum consumption of water, electric energy and detergents.

SUMMARY OF THE INVENTION

The invention has as its object the elimination of the drawbacks and limitations described above by providing a washing machine which is designed to enable the operator to carry out the same laundering procedures as the prior art washing machine, automatically and with any desired load placed in the basket.

According to the present invention, a washing machine is provided which is substantially identical to that described in U.S. Pat. application, Ser. No. 677,302, but which has fewer pressure switches or similar water-level regulators for setting water levels in the tub to fit the size of load placed in the basket in each particular case.

The above and other objects of the present invention are achieved by provision of a washing machine, comprising a wash tub, a spinning wash basket disposed within the wash tub and a housing for collecting the wash water located below and connected to the wash tub. The housing has at least one heating element and one thermostatic sensor capable of, respectively, heating and controlling the temperature of the wash water. The housing further is connected to the tub by at least one conduit and one electric recirculation pump which is adapted to cause the wash water to be circulated repeatedly from the housing to the tub. The washer further comprises means of controlling the washing liquid level and an electric valve or similar means, all of which are connected to an electric circuit of the machine.

The washing machine is characterized in that the control means includes first, second, third, and fourth pressure switches or similar water-level regulators, which can be connected selectively to the electric valve. First and second pressure switches are calibrated so as to cause the tub to be filled with washing liquid at a preset level and the housing to be filled with washing liquid at a minimum level, respectively. The pressure switches are also selectively connected to the heating element and to the thermostatic sensor and the second pressure switch is designed to switch on the electric recirculation pump switch. The third pressure switch is calibrated so as to cause the tub to be filled with water at another preset level lower than that set by the first pressure switch for any type and quantity of load placed in the basket. The fourth pressure switch is calibrated so as to cause the tub to be filled with water at a higher level than those set by the first and third pressure switches.

BRIEF DESCRIPTION OF THE DRAWINGS

Other objects, features and advantages of the invention will be better understood from the following description in conjunction with the accompanying drawings, wherein.

DETAILED DESCRIPTION OF THE INVENTION

Figure 1:
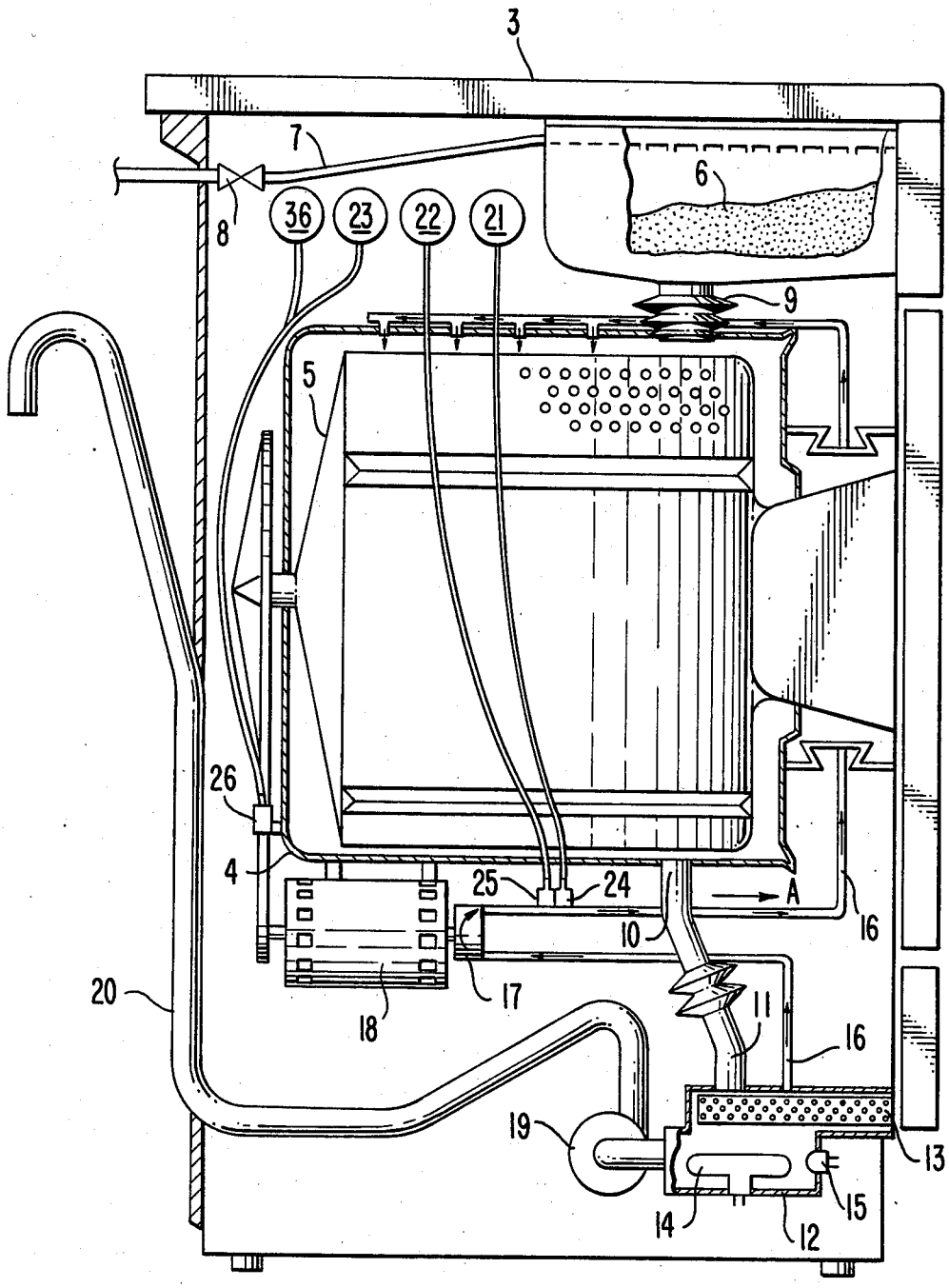
FIG. 1 is a schematic representation of a washing machine according to the invention in a side elevational view.

Now, referring to FIG. 1, a washing machine according to the invention comprises a cabinet 3, a wash tub 4 located therein in a conventional manner, as well as a wash basket 5 designed for holding the load to be washed and for spinning in the tub.

On the upper part of the machine, there is further provided a container 6 for the detergent used in the wash cycle which is connected to a water supply by a hose 7 and an electric valve 43. The bottom of container 6 is provided with a flexible hose 9 joined to the tub 4 for the introduction of water and detergents into the tub.

The lower part of the tub 4 has an outlet 10 connected by a flexible hose 11 to a housing 12 for collecting the wash water coming from the tub. The housing is sized to accommodate a fine-mesh filter 13 or any other appropriate filter element of a conventional type which is removably disposed within the housing. (See for example the filter disclosed in U.S. application, Ser. No. 604,363, filed Apr. 26, 1984). The filter allows the wash water coming from the tub 4 to pass therethrough but retains the dirt particles encountered in the water during the washing action.

The housing 12 contains at least one heating element 14 and one conventional-type thermostatic sensor 15 capable of, respectively, heating and controlling the temperature of the wash water introduced into the housing.

This housing is further connected to the upper part of the tub 4 through a conduit 16 joined to the upper part of the housing and to an electrical recirculation pump 17 concentric with a motor 18 of the washing machine and driven thereby so as to cause the wash water to be circulated repeatedly from the housing 12 to the tub 4 during the various laundering operations of the washing machine according to the present invention.

Finally, the housing is also connected to a discharge pump 19 and a flexible discharge hose 20 in order to pump wash water from the housing to a drain upon completion of the wash cycle.

The washing machine which has been described so far is identical to that described in U.S. application, Ser. No. 677,302, filed Dec. 3, 1984 in which application the operating modes and other embodiments of the machine are further described.

To control the level of the water introduced into the washing machine of the present invention, there are provided three pressure switches 21, 22 and 23 or similar water-level regulators. Pressure switches 21 and 22 are connected to air traps 24 and 25, respectively. Air traps 24 and 25 are provided in the recirculation conduit 16 downstream of the electric recirculation pump 17, as shown in FIG. 1 with respect to the direction in which the wash water circulates through the conduit (indicated by the arrow A). Pressure switch 23 is connected to air trap 26 provided in the lower part of the tub 4. In particular, the pressure switch 21 is operative to set a minimum wash water level in the housing 12 which remains unchanged with any quantity and kind of load placed in the basket 5 and is sufficient to completely cover the heating element 14. The corresponding movable electric contact 27 of pressure switch 21 (FIG. 2) is switched to either a contact 28 or to a contact 29 of the pressure switch. In one instance, contact 27 is switched to contact 28 when the housing 12 is empty or has been filled with the wash water below a minimum filling level. In a second instance, contact 27 is switched to contact 29 when the minimum level of the water in the housing has been reached.

The pressure switch 22 is operative to set a predetermined filling level of the water in the tub 4 which is higher than the previous minimum level set by pressure switch 21 for any quantity and kind of load placed in the basket 5 in order to allow the clothes to soak to a sufficient degree to ensure adequate laundering. An example of this type of pressure switch is available from a manufacturer by the name of ELBI and the pressure switch is identified by model number 785 and serial number P.

In particular, the pressure switch 22 is sensitive to pressure variations occurring in the recirculation conduit 16 during the recirculation of the wash water pumped through the conduit by the electric pump 17. A corresponding movable electrical contact 30 of pressure switch 22 (FIG. 2) is switched to either a contact 31 or contact 32 (which is not connected to any further conductor).

The contact 30 remains connected to contact 31 when the wash water is either not circulated through the recirculation conduit 16 or is circulated therethrough at a rate of flow lower than the maximum rate of flow permitted by the calibration of the pressure switch 22. The rate of flow of the wash water in conduit 16 may be reduced due to the fact that this water is gradually absorbed by the load placed in the basket 5. Pressure switch 22 then senses a corresponding absence or lowering of the pressure of the water circulating through the conduit 16, which corresponds to a water level in the tub which is lower than the preset maximum pressure.

When water is not circulated through recirculation conduit 16, movable contact 30 is held in contact with contact 31 so that more water is introduced into the wash tub. Contact 30 is maintained in contact with contact 31 when the water is circulated through the conduit 16 with rate of flow lower than the maximum rate of flow permitted by the calibration of the pressure switch 22, so that the supply of water to the tub is not interrupted and the clothes are allowed to soak with wash water in the desired quantity. When pressure switch 22 senses a corresponding maximum pressure of the water circulating through the conduit 16 contact 30 is shifted to contact 32. This pressure corresponds to the maximum level of the water introduced into the tub 4 and is dependent upon the load placed in the basket. Therefore, the purpose of the pressure switch 22 is to adjust the quantity of water introduced into the wash tub, depending on the kind of load and the corresponding liquid-absorbing power thereof.

The remaining pressure switch 23 is calibrated so as to set another predetermined water level in the tub which is higher than that set by the preceding pressure switch 22 for any quantity and kind of load placed in the basket 5.

Pressure switch 23 controls the water level used solely for rinsing the load to be washed. The corresponding movable electrical contact 33 of this pressure switch (FIG. 2) can be switched to two different operating positions. Switch 33 is shifted to the contact 34 when the tub 4 is completely empty or filled with water to a lower level than the maximum level set by the calibration of the pressure switch 23. Contact 33 is shifted to contact 35 (which is not connected to any further conductor) when the tub is filled with wash water up to the maximum water level.

Finally, the washing machine of the present invention has another pressure switch 36 or similar water level regulator (FIG. 2) which is connected to air trap 26 of the tub 4. Pressure switch 36 is calibrated so as to set a predetermined water level in the tub which is preferably higher than that set by the pressure switch 22 and lower than that set by the pressure switch 23.

Figure 2:
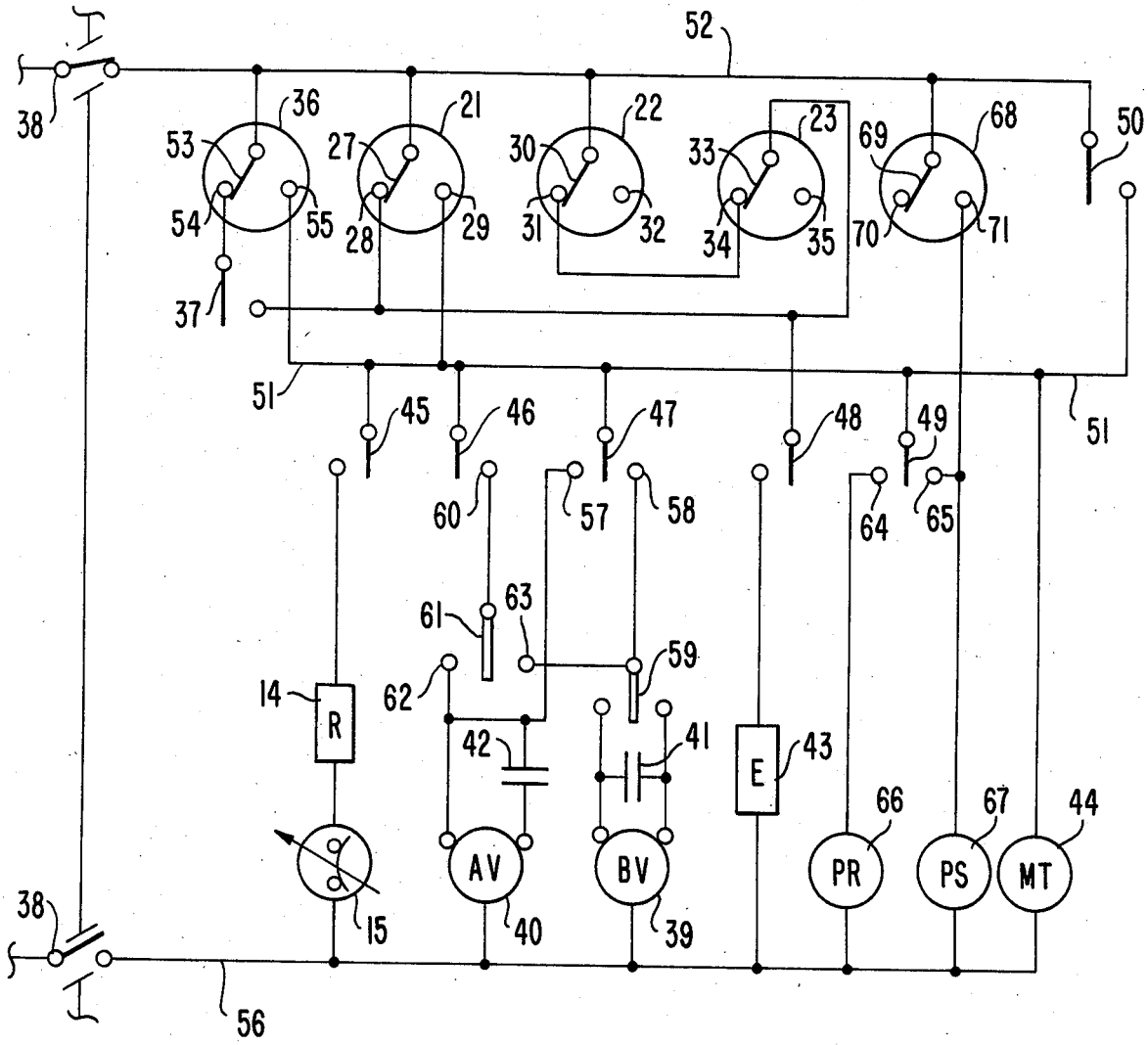
FIG. 2 shows the wiring diagram of the washing machine of the invention.

Now, referring to FIG. 2, it is apparent that the machine's electric circuit can be connected to the electric supply of a power source through a common switch 38. The electric circuit includes, in addition to the pressure switches 21, 22, 23 and 36 and the other components described above, the windings 39 and 40 of the motor 18. There windings generate, respectively, the low laundering speed and the high centrifuging speed of the motor and are connected to respective start-up capacitors 41 and 42.

This circuit also includes an electric valve 43 or a similar device for introducing water into the washer, as well as a motor 44 for a programmer of a conventional type which is understood by persons skilled in the art. This programmer has a series of electric contacts 37, 45, 46, 47, 48, 49 and 50 actuated by the corresponding cams of the programmer, the contacts being adapted to selectively connect the various electric components of the machine in the manner described as follows.

Specifically, the contacts 45, 46, 47 and 49 are connected to a common electric conductor 51. These contacts are energized by the main conductor 52 of the electric circuit by means of the pressure switch 21 or 36.

In the first case, the movable contact 27 of the pressure switch 21 is connected to the main conductor 52, while the fixed contacts 28 and 29 of the pressure switch 21 are connected, respectively, to the contact 48 of the programmer and to the above mentioned common conductor 51. In the second case, the corresponding movable contact 53 of the pressure switch 36 is connected to the main conductor 52, while the fixed contacts 54 and 55 are connected to, respectively, the fixed contact 28 of the pressure switch 21 by means of the contact 37 of the programmer and to the other fixed contact 29 of pressure switch 21. Contact 48 can be energized by connecting movable contact 53 to contact 54 which in turn is connected to contact 48 through contact 37 of the programmer. In addition, the contact 48 can be energized by the main conductor 52 by means of the two pressure switches 22 and 23. The corresponding two fixed contacts 31 and 34 of pressure switches 22 and 23 are connected in series to each other. The corresponding movable contacts 30 and 33 of pressure switches 22 and 23 are connected to, respectively, the main conductor 52 and to the contact 48. In this way, the contact 48 is energized even when the movable contacts 30 and 33 are shifted to, respectively, the contact 31 of the pressure switch 22 and to the contact 34 of the pressure switch 23.

Therefore, in this condition the two pressure switches 22 and 23 are connected in series to each other and in parallel both to the fixed contact 28 of the pressure switch 21 and to the fixed contact 54 of the pressure switch 36 by means of the contact 37 of the programmer. The remaining contact 50 of the programmer is connected directly to the main conductor 52 and can be switched by the programmer to the common conductor 51. The purpose of the contact 50 is to always keep the motor 44 of the programmer energized, even during the program phases during which this motor is no longer energized by one of the corresponding pressure switches 36 and 21, when the movable contacts 53 and 27 of said pressure switches are shifted to the corresponding fixed contacts 54 and 28.

The connections that can be established by means of the electric contacts of this programmer will now be described in detail.

In particular, the contact 45 of the programmer can be closed on a circuit made up of the heating element 14 and the thermostatic sensor 15 connected in series to each other and to the other main conductor 56 of the washer's electric circuit. The contact 47 of the programmer can be switched to either the contact 57 or to the contact 58 so as to connect to the main conductor 56, respectively, the high-speed windings 40 with the corresponding starting capacitor 42, or the low-speed windings 39 of the motor 18 with the corresponding starting capacitor 41 by means of the inverter 59 for driving the motor with alternating directions of rotation. In a similar manner, the contact 46 of the programmer can be switched to the fixed contact 60 connected to another inverter 61 which can be switched to either the contact 62 or to the contact 63 connected to, respectively, the high-speed windings 40 and the inverter 59 capable of turning on the low-speed windings 39 of the motor 18 in the manner described above.

The contact 48 of the programmer can be switched to the electric valve 43 connected to the main conductor 56, while the remaining contact 49 of the programmer can be switched to either of the fixed contacts 64 and 65 connected, respectively, to the motor 66 of the electric recirculation pump 17 and to the motor 67 of the draining pump 19, the motors being both connected to the main conductor 56.

Finally, the motor 44 of the programmer is connected directly between the common conductor 51 and the main conductor 56. The present electric circuit, except for the pressure switches 21, 22, 23 and 36, is made up of the same electric components connected to one another in the same way as the circuit described in U.S. application, Ser. No. 677,302, filed Dec. 3, 1984. Therefore, with the washing machine of the present invention it is possible to carry out "vigorous" laundering procedures at normal water levels for not too heavily soiled cotton and/or synthetic fabrics resistant to high temperatures, as well as "vigorous" laundering procedures at low water levels for washing heavily soiled cotton and/or other synthetic fabrics resistant to high temperatures.

In addition, the present invention also enables the operator to carry out conventional laundering procedures for washing delicate synthetic fabrics and/or woolen fabrics. If desired, the washing machine according to the invention may also be provided with a suitable anti-overflow device designed to prevent excessive water levels in the machine.

By way of illustrative example, an anti-overflow device can consist of a further pressure switch 68 or similar level regulator provided with a movable contact 69 connected to the main conductor 52 and movable to either of the fixed contacts 70 and 71. Contact 71 is connected to the motor 67 of the draining pump 19 and pressure switch 68 is mechanically connected to the previously described air trap 26 in order to sense the level of the water introduced into the tub (FIG. 1).

Furthermore, pressure switch 68 is calibrated so that the corresponding movable contact 69 is shifted to the contact 70 (which is not connected to any further conductor) when the water level in the tub is lower than a maximum preset level, or to the contact 71 when the maximum water level has been reached. This last condition, in particular, can for instance be reached in the event of a malfunction in the electric valve 43 and/or in the remaining pressure switches of the machine, which could cause the tub 4 to be filled with an excess of wash water. Consequently the shifting of the movable contact 69 of the pressure switch 68 to contact 71 will cause the motor 67 of the draining pump 19 to drain to the outside the excess water introduced into the tub. Therefore, as soon as the water level in the tub has dropped below the maximum level described above, movable contact 69 will again return to the contact 70, thereby cutting off the motor 67 of the draining pump 19.

The electric circuit according to the present invention, instead of being equipped with the five pressure switches 21, 22, 23, 36 and 68, can also be advantageously designed with only two pressure switches. In this case, one of these pressure switches can consist of the interrelating combination of the pressure switches 21 and 22 electrically connected to the washing machine circuit in the same manner as in FIG. 2, as well as mechanically connected to a single air trap, for example, air trap 25 (FIG. 1). Instead of using the two pressure switches 21 and 22, each having a single movable contact (27 and 30 respectivley), a single pressure switch may be used which is provided with two movable contacts, activated by two different air pressures in the same manner described earlier in the specification. Such a single pressure switch, also, is mechanically connected to a single air trap in the recirculation conduit 16 and is electrically connected to the programmer of the machine as described earlier in the specification. A type of single pressure switch which may by used in the present invention is made by EATON, and is identified by the model number PD 4. Likewise, the other pressure switch can consist of the interrelating combination of the pressure switches 23, 36 and 68 electrically connected to the washer's circuit depicted in FIG. 2, as well as mechanically connected to the single air trap 26. Instead of using the three pressure switches 23,36 and 68, each having a single movable contact (33,53 and 69 respectively), a single pressure switch may be used which is provided with three movable contacts, activated by three different air pressures in the same manner described earlier in the specification. Such a single pressure switch, also, is mechanically connected to air trap 26 and is electrically connected to the programmer of the machine as described earlier in the specification. A type of single pressure switch which may be used in the present invention is made by EATON, and is identified by the model number P 3.

The following description is of the various laundering operations that the machine according to the invention is capable of performing. In particular, this washer enables "vigorous" laundering procedures to be carried out both with a normal and with a low water level in the tub for any load placed in the basket. In the first case for normal water levels, the laundering is carried out by introducing into the tub a wash water level determined by the pressure switch 36, while in the second case, for low water levels, the water level is controlled by the pressure switches 21, 22 and 23 in the manner described below.

To carry out the "vigorous" laundering procedures with a normal water level in the tub, the movable contact 53 of the pressure switch 36 is first shifted to the contact 54, while the contacts 37 and 48 of the programmer are shifted to a closed position so as to cause the electric valve 43 to be switched on. Consequently, the latter is energized and the water is introduced into the wash tub. Then when a desired water level in the tub is reached, the movable contact 53 of the pressure switch 36 is shifted to the other contact 55, thereby disconnecting the electric valve and powering the contacts 45, 46, 47 and 49 of the washer's programmer. During the laundering operations, the wash water is heated to maximum temperatures of 90° C and the wash basket is spun at the wash speed, with alternating directions of rotation, and at the centrifuging rate by connecting the corresponding low-speed windings 39 and the high-speed windings 40 of the motor 18 solely by means of the contact 47 and the inverter 59. On the other hand, the motor 66 of the electric recirculation pump 17 is never connected by the corresponding contact 49 of the programmer.

Likewise, in order to carry out "vigorous" laundering procedures with a low water level in the tub, the movable contact 27 of the pressure switch 21 is first shifted to the contact 28, while the corresponding contacts 45 and 48 of the washer's programmer are shifted to, respectively, the circuit of the heating element 14 and of the thermostat sensor 15, as well as to the circuit of the electric valve 43. The contact 37 of the programmer itself is shifted to the open position, thereby keeping the fixed contact 54 of the pressure switch 36 disconnected from the contact 48 of the programmer. Consequently, the electric valve 43 is energized and the liquid is introduced into the housing 12, with a filling level solely determined by the pressure switch 21.

Then, when the minimum preset water level provided in the housing 12 is reached, the movable contact 27 of the pressure switch 21 is shifted to the contact 29, thereby disconnecting the electric valve 43 and at the same time energizing the common conductor 51 and the corresponding electric contacts 45, 46, 47 and 49 of the programmer. This starts the heating of the wash water contained in the housing 12.

Subsequently, the programmer acts to keep the contact 45 shifted to the circuit of the heating element 14 at all times and to switch the contact 49 to the contact 64, thereby causing the motor 66 of the electric recirculation pump 17 to be switched on. Consequently, pump 17 causes the wash water to be circulated repeatedly from the housing 12 to the tub 4 through the recirculation conduit 16. In this condition, the pressure switch 22 first senses a minimum dynamic pressure of the liquid circulating in the recirculation conduit 16 which corresponds to a water level in the tub which is lower than the maximum level set by the calibration of the pressure switch 22. As a result of this pressure, the movable contact 30 of the pressure switch 22 is shifted to the contact 31. The movable contact 33 of the pressure switch 23 itself is shifted to the contact 34, since this pressure switch is calibrated so as to enable wash water to be introduced into the tub at a higher level than that set by the pressure switch 22. Thus, the pressure switches 22 and 23 are connected in series to each other and to the circuit of the electric valve 43, since the programmer acts to keep the corresponding contact 48 shifted to the circuit of the electric valve 43 at all times.

Therefore, more wash water is introduced into the housing 12 and the water is absorbed by the load placed in the wash basket 5 until the articles are allowed to soak sufficiently long enough to be washed efficiently. Then, when the pressure switch 22 senses the maximum pressure of the wash water circulating through the recirculation conduit 16 which corresponds to the maximum water level in the tub, the corresponding movable contact 30 of the pressure switch 22 is switched to the open contact 32, thereby turning off the electric valve 43 and interrupting the supply of water to the washer.

In this condition, the tub 4 is filled with water at a level lower than that set by the pressure switch 36 during the "vigorous" laundering procedures mentioned earlier. Moreover, the presence of the pressure switch 22 enables the quantity of water introduced into the tub to be adjusted to any kind and quantity of load placed in the wash basket. This is a considerable improvement over the solution proposed in U.S. application, Ser. No. 677,302, in which specific pressure switches or similar water level regulators are used to set water levels in the tub to fit the size of load in the basket.

During the wash cycles of the present invention, the wash water is heated to a maximum temperature of 90° and the basket is spun both at the wash speed, with alternating directions of rotation, and at the centrifuging speed for periods shorter than those of conventional "vigorous" laundering operations. In this case, these wash and centrifuging speeds are achieved by switching the contact 46 of the programmer to the contact 60 and shifting the inverter 61 either to the contact 63 or the contact 62.

Furthermore, the recirculation pump 17, too, remains energized at all times during the wash cycle to ensure the continuous recirculation of the wash water from the housing 12 to the tub 4 through the conduit 16. Therefore, during the washing cycle the clothes are always allowed to soak with wash water and thus cannot be damaged by the spinning of the basket. Then, when the wash cycle is completed, the recirculation pump 17 is turned off and the electric valve 43 is turned on again by means of the corresponding movable contacts 30 and 33 of the pressure switches 22 and 23, as well as by the contact 48 of the programmer, which energizes the circuit of the electric valve. Since pressure sensor 22 is connected to air trap 25 in conduit 16, when washing fluid is not pumped through conduit 16 the movable contact 30 of pressure switch 22 is connected to contact 31 which allows a higher level of washing fluid to be placed in the tub than when pump 17 is operating. Movable contact 33 of pressure switch 23 is connected to contact 34 until a desired rinse level of washing fluid is detected by pressure in air trap 26 located in the lower part of the tub 4. Thus, more water is introduced into the tub 4 in order to gradually cool the water in the tub and thereby the clothes as well. This enables subsequent rinse cycles to be carried out without creating any undesirable wrinkles in the clothes. Thereafter, the electric valve 43 is switched off and motor 67 of the draining pump switched on, which then acts to exhaust to the outside all of the wash water in the tub 4.

For the rinse cycles, the movable contact 33 of the pressure switch 23 is first shifted to the contact 34, while the movable contact 30 of the pressure switch 22 is shifted to the contact 31. Moreover, the washer's programmer switches the corresponding contact 48 to the circuit of the electric valve 43, holding it in this position. Thereupon, when the water reaches the preset level in the tub 4, the movable contact 33 of the pressure switch 23 is shifted to the contact 35, switching off the electric valve 43 and interrupting the water supply to the tub. The rinse cycles are executed in the conventional way and when they are completed the draining pump 19 is switched on to exhaust to the outside all of the waste water contained in the tub 4.

Finally, the "delicate" wash cycles are performed by introducing into the washer the water together with the detergent, as in the case of the "vigorous" laundering procedures mentioned earlier, the water being introduced up to the level which, in this case as well, is set by the pressure switch 23. When a preset water level is reached the contact 33 of the pressure switch 23 is switched to the contact 35, thereby switching off the electric valve 43, while the programmer acts to turn on the heating element 14. The delicate wash cycles are carried out in the conventional way, always keeping the recirculation pump 17 switched off and driving the motor of the wash basket only at the low rate with alternating directions of rotation by means of the contact 46 of the programmer and inverters 61 and 59.

Thus, the washer incorporating the invention enables the operator to carry out not only the conventional "vigorous" and "delicate" laundry procedures, but also "vigorous" laundering procedures with low water levels in the tub. These latter wash cycles in particular permit the operator to reduce the quantity of water, detergents, and electrical energy consumed compared to conventional "vigorous" wash cycles. In addition, the consumption of water and energy is optimum for every load placed in the basket in view of the fact that the level of wash water introduced into the tub can be adjusted to fit the size of load, thereby reducing the time required to heat the water. According to the invention, this operation is carried out automatically by means of the pressure switches 21, 22 and 23, without requiring a manual selection of the wash cycles in accordance with the particular load to be laundered. Moreover, a further advantage of this washer is the fact that it uses fewer pressure switches when compared to the washer according to the invention disclosed in U.S. application, Ser. No. 677,302.

Another feature of the invention is that, it is possible to use only two pressure switches obtained by incorporating, respectively, the pressure switches 21 and 22 as well as the pressure switches 23, 36 and 68 to carry out "vigorous" wash cycles with a low level of water in the tub. Finally, these pressure switches can also be connected in different positions, depending on the recirculation conduit 16 and the tub 4.

While the invention has been shown in several forms, it will be obvious to those skilled in the art that it is not so limited, but is susceptible of various changes and modifications without departing from the spirit and scope of the invention.

I claim:

1. A washing machine comprising:

a wash tub having a basket therein;

a housing positioned below said wash tub and in fluid communication with said wash tub;

at least one heating element provided in said housing;

at least one thermostatic sensor provided in said housing, said at least one thermostatic sensor connected to said at least one heating element for controlling the temperature of washing liquid contained in said housing;

a recirculation conduit in fluid communication with said wash tub and said housing;

electric recirculation pump mea.ns in fluid communication with said recirculation conduit for recirculating washing liquid from said housing to said wash tub;

means for automatically controlling the filling level of washing liquid into said wash tub including an inlet hose for supplying washing liquid to said wash tub, an electric valve in fluid communication with said inlet hose for controlling the amount of washing liquid supplied to said wash tub, washing liquid level sensor means for controlling the level of washing liquid supplied to the wash tub, and electric circuit means connected to said electric valve and said washing liquid level sensor means for operating said electric valve in response to signals from said washing liquid level sensor means;

said washing liquid level sensor means including a first pressure switch operatively connected to said electric valve and said electric circuit means for causing the addition of washing liquid to said tub at a normal level regardless of the type or quantity of the load placed in said wash tub, a second pressure switch operatively connected to said electric valve and said electric circuit means for causing the addition of washing liquid to said housing at a level above said at least one heating element and said at least one thermost,atic sensor, a third pressure switch operatively connected to said electric valve and said electric circuit means for causing the addition of washing liquid to said tub at a level which is dependent on the load placed in said tub but is lower .than the level set by said first pressure switch, and a fourth pressure switch operatively connected to said electric valve and said electric circuit for causing the addition of washing liquid to said tub at a level higher than the washing liquid levels set by said first and third pressure switches.

2. The washing machine set forth in claim 1, wherein said first pressure switch is mechanically connected to said tub for detecting a preset level of washing liquid in said tub, said first pressure switch includes at least one movable electric contact which is selectively connected to a first operating position in which said at least one movable electric contact is operatively connected in series with said electric valve or to a second operating position in which said at at least one movable electric contact is operatively connected in series to said heating element and said thermostatic sensor, said at least one movable electric contact being moved to said second position when said first pressure switch detects a preset level of washing liquid is present in said tub.

3. The washing machine of claim 2, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said was tub.

4. The washing machine of claim 3, wherein said first pressure switch, said fourth pressure switch and said safety anti-overflow switch are combined into a single pressure switch which performs the functions of said first pressure switch, said fourth pressure switch and said safety anti-overflow safety switch.

5. The washing machine set forth in claim 1, wherein said second pressure switch is mechanically connected to said recirculation conduit, said second pressure switch being operable to detect the pressure of washing liquid in said housing corresponding to a preset minimum level of washing liquid in said housing, said second pressure switch including at least one movable electric contact which is selectively connected to a first operating position in which said at least one movable electric contact of said second pressure switch is operatively connected in series with said electric valve or to a second operating position in which said at least one movable electric contact of said second pressure switch is operatively connected in series with said heating element, said thermostatic sensor and said electric recirculation pump means, said at least one movable electric contact of said second pressure switch being moved to said second position when said second pressure switch detects a minimum preset level of washing liquid is present in said housing.

6. The washing machine of claim 5, wherein said second and said third pressure switches are incorporated into a single pressure switch which performs the functions of said second and said third pressure switches.

7. The washing machine of claim 6, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said wash tub.

8. The washing machine of claim 7, wherein said first pressure switch, said fourth pressure switch and said safety anti-overflow switch are combined into a single pressure switch which performs the functions of said first pressure switch, said fourth pressure switch and said safety anti-overflow safety switch.

9. The washing machine of claim 5, wherein said fourth pressure switch is mechanically connected to said wash tub, said fourth pressure switch being operable to detect a maximum preset filling level of washing liquid in said wash tub, said fourth pressure switch including at least one movable electric contact which is selectively connected to a first operating position in which said at least one movable electric contact of said fourth pressure switch is operatively connected in series to said electric valve and to said at least one movable contact of said third pressure switch or to a second position in which said at least one movable electric contact of said fourth pressure switch is not operatively connected to said electric valve, said at least one movable electric contact of said fourth pressure switch being moved to said second position when said fourth pressure switch detects a maximum preset filling level of washing liquid in said wash tub.

10. The washing machine of claim 9, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said wash tub.

11. The washing machine of claim 10, wherein said first pressure switch, said fourth pressure switch and said safety anti-overflow switch are combined into a single pressure switch which performs the functions of said first pressure switch, said fourth pressure switch and said safety anti-overflow safety switch.

12. The washing machine of claim 5, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said wash tub.

13. The washing machine of claim 12, wherein said first pressure switch, said fourth pressure switch and said safety anti-overflow switch are combined into a single pressure switch which performs the functions of said first pressure switch, said fourth pressure switch and said safety anti-overflow safety switch.

14. The washing machine of claim 1, wherein said third pressure switch is mechanically connected to said recirculation conduit, said third pressure switch being operable to detect the pressure of washing liquid present in said recirculation conduit, said third pressure switch including at least one movable electric contact which is selectively connected to a first position in which said at least one movable electric contact of said third pressure switch is operatively connected in series with said electric valve by means of said fourth pressure switch or to a second position in which said at least one movable contact of said third pressure switch is not operatively connected to said electric valve, said at least one movable contact of said third pressure switch being moved to said second position when the pressure detected in said recirculation conduit corresponds to a maximum preset pressure which is dependent on the load placed in said basket of said tub.

15. The washing machine of claim 14, wherein said second and said third pressure switches are incorporated into a single pressure switch which performs the functions of said second and third pressure switches.

16. The washing machine of claim 15, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said was tub.

17. The washing machine of claim 16, wherein said first pressure switch, said fourth pressure switch and said safety anti-overflow switch are combined into a single pressure switch which performs the functions of said first pressure switch, said fourth pressure switch and said safety anti-overflow safety switch.

18. The washing machine of claim 14, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said wash tub.

19. The washing machine of claim 18, wherein said first pressure switch, said fourth pressure switch and said safety anti-overflow switch are combined into a single pressure switch which performs the functions of said first pressure switch, said fourth pressure switch and said safety anti-overflow safety switch.

20. The washing machine of claim 1, further comprising a safety anti-overflow device capable of preventing excessive filling of washing liquid into said wash tub, said safety anti-overflow device including a draining pump means for exhausting washing liquid from said wash tub, at least one pressure switch which is mechanically connected to said wash tub and electrically connected to said electric circuit means, said at least one pressure switch of said safety anti-overflow device being operable to detect a maximum preset filling level of washing liquid in said wash tub, said at least one pressure switch of said safety anti-overflow device including at least one movable electric contact which is selectively connected to a first operating position in which said draining pump is not actuated by said at least one pressure switch of said safety anti-overflow device or to a second position in which said at least one movable contact of said safety anti-overflow device is operatively connected to said draining pump for causing said draining pump means to exhaust washing liquid from said wash tub when said safety anti-overflow device detects a maximum preset level of washing liquid in said wash tub.

21. The washing machine of claim 20, wherein said first pressure switch, said fourth pressure switch and said safety anti-overflow switch are combined into a single pressure switch which performs the functions of said first pressure switch, said fourth pressure switch and said safety anti-overflow safety switch.

* * * * *